United States Patent [19]

Segmuller

[11] 4,192,428

[45] Mar. 11, 1980

[54] BOTTLE CAP

[76] Inventor: Bruno J. Segmuller, Niderfeld 766, 8260 Stein am Rhein, Switzerland

[21] Appl. No.: 933,885

[22] Filed: Aug. 15, 1978

[30] Foreign Application Priority Data

Aug. 16, 1977 [CH] Switzerland ..... 10173/77

[51] Int. Cl.[2] ..... B65D 45/32

[52] U.S. Cl. ..... 215/256; 215/272; 215/307; 215/354

[58] Field of Search ..... 215/250, 251, 253, 256, 215/272

[56] References Cited

U.S. PATENT DOCUMENTS

| | | | |
|---|---|---|---|
| 2,949,205 | 8/1960 | Fitz | 215/272 |
| 3,630,404 | 12/1971 | Guala | 215/251 |
| 3,905,502 | 9/1975 | Wassilieff | 215/272 X |
| 3,974,932 | 8/1976 | Faulstich | 215/256 |

*Primary Examiner*—Donald F. Norton
*Attorney, Agent, or Firm*—Abraham A. Saffitz

[57] ABSTRACT

A bottle cap which reliably seals a bottle at high and low temperatures and which nevertheless can easily be removed by hand without a tool. The cap is made of two parts: An outer cap member of hard plastic material and a sealing insert of soft plastic material. In the closed position the outer cap member is fixed against the inner sealing member by means of a detachable opening ring, which firmly holds the sealing insert clinging to the bottle opening.

3 Claims, 1 Drawing Figure

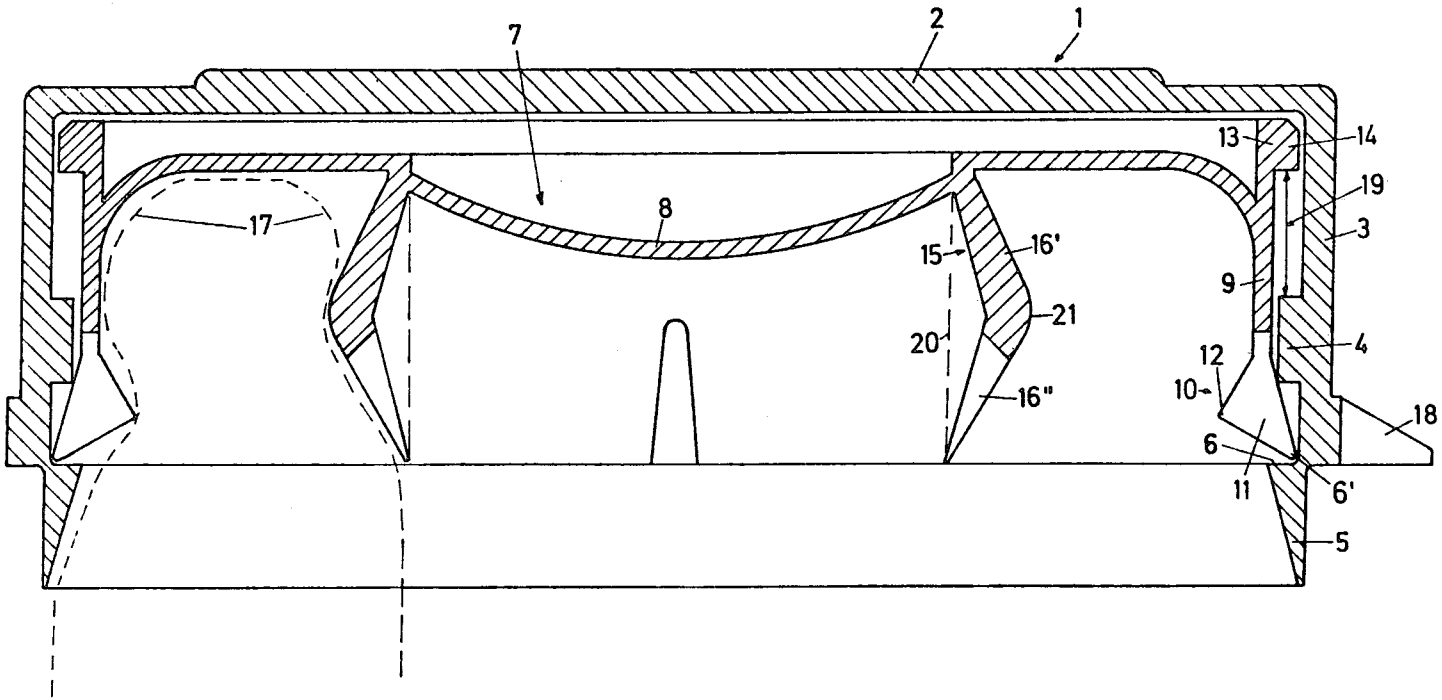
1
2
7
8
9
10
11
12
13
14
15
16'
16"
17
18
19
20
21
3
4
5
6
6'

BOTTLE CAP

FIELD OF THE INVENTION

The present invention refers to a bottle cap comprising an outer cap member and a sealing member inserted into said outer cap member.

BACKGROUND OF THE INVENTION

The so-called crown cork caps are well known and widely used, comprising an outer cap member usually made of metal and a sealing insert made of cork or a soft plastic material, whereby upon closing the bottle after filling the lower free edge of the outer cap member is bent against the bottle by means of a flanging press. These known caps have the disadvantage that the closing process is quite delicate and time consuming and that you need a tool to open the bottle, a re-closing of the bottle by means of the same cap being excluded as it usually is more or less deformed.

Other caps are known which are made of a plastic material. Usually, there is used quite a soft plastic material in order to ensure that the cap firmly clings to the edges of the bottle opening and thereby preventing an escaping of liquid or $CO_2$. A disadvantage of these caps lies in the fact that they become toosoft at higher temperatures and the sealing effect is highly degraded. On the other hand, the pressure in the bottle becomes higher at increasing temperatures and the load onto the cap is higher too. If a plastic material is used, that is harder and thereby more heat-resistant a reliable sealing of the bottle is ensured, but such hard plastic caps are difficult to remove from the bottle by hand, often requiring a tool to open the bottle.

OBJECTS OF THE INVENTION

It is an object of the present invention to provide a bottle cap which combines all the advantages of the known bottle caps, but avoids the disadvantages mentioned above. Another object of the invention is to provide a bottle cap which reliably seals a bottle under any circumstances, either at high or at low temperatures. Still a further object of the invention is to provide a cap which can easily be removed by hand without the need to use a tool and which may be used again and again to reliably seal the bottle. Finally, another object of the invention is to provide a cap which can easily be manufactured in great quantities and which is inexpensive.

SUMMARY OF THE INVENTION

The invention provides a bottle cap comprising an outer cap member and a sealing member arranged in said outer cap member, said sealing member comprising a retaining means circumferentially clasping the edge of the bottle opening and consisting of a pluriality of individual retaining tongues, which abut with their back against a stop collar provided at the interior of the side wall of said outer cap member and with their lower ends against the upper face of an opening ring provided at the lower edge of the side wall of said outer cap member, thereby preventing an axial displacement of said sealing member relative to said outer cap member, said opening ring being removeable and thereby enabling an axial displacement of said outer cap member relative to said sealing member, so that said retaining tongues are free of said stop collar to move back upon removing of the cap from the bottle. In order to limit the axial displacement of the outer cap member relative to the sealing member, the latter can be provided at its top with a radially protruding collar cooperating with the stop collar at the inner face of the side-wall of the outer cap member.

BRIEF DESCRIPTION OF THE DRAWING

An embodiment of the bottle cap according to the invention is schematically shown in a cross section in the accompanying drawing and will be described, by way of example only, in further detail below.

The bottle cap shown in the attached drawing comprises an outer cap member 1 which consists of a circular top part 2 and a cylindrical side wall 3 with corrugated outside. The side wall 3 comprises on its inner side a stop collar 4, and the bottom of the side wall 3 has a detachable opening ring 5 slightly protruding inwardly. The upper front face 6 of the opening ring 5, also protruding inwardly, thereby forms an abutment for an inner sealing insert 7.

The entire outer cap member 1 is made of a hard, heat-resistant synthetic plastic material.

As mentioned above, the outer cap member 1 serves to receive an inner sealing insert 7 which, in contrast to the outer cap member 1, consists of a soft, elastic synthetic plastic material. The sealing insert 7 comprises a top member 8 and a cylindrical outer side wall 9, the edge of which being formed into a retaining collar 10 surrounding the bottle opening. This retaining collar 10 does not have the form of a continuous closed ring, but consists of a plurality of individual retaining tongues 11 inwardly cambered at 12. The outer side wall 9 and the retaining tongues 11 are so dimensioned that the latters, in the normal closed position as shown in the drawing, abut with their outer planes against the collar 4, whereby they cannot move outwardly. A displacement of the sealing insert in axial direction is also prevented as the lower front face 6′ of each of the retaining tongues 11 abuts against the opening ring 5. For further preventing an axial displacement of the sealing insert 7, its outer side wall 9 is provided with an upper cylindrical extension 13 with an integral collar 14 protruding outwardly in radial direction, the extension 13 abutting with its upper front face against the inner face of the circular top part 2 of the cap member 1. The sealing insert 7 is further provided with an inner sealing member generally designated by 15, comprising a conically enlarged upper part 16′ and a conically tapered lower part 16″, the latter being subdivided by circumferentially arranged slots.

The sealing insert 7, made of a soft, elastic synthetic plastic material, clings to the edges 17 of the bottle opening on the one hand by the inner sealing member 15 and on the other hand by the outer side wall 9, the recess in the outer edge of the bottle being undergrasped by the retaining tongues 11. The tongues 11 cannot evade in outward direction under the influence of a high pression in the bottle, as they abut against the inner stop collar 4.

In order to open a bottle fitted with a cap member 1 as described above, firstly the opening ring 5 is removed. Then the outer cap member is displaced upwardly by pulling the handle 18, thereby providing an axial movement relative to the sealing insert 7 along a distance designated with arrow 19. In this position the inner stop collar 4 of the outer cap member abuts against the collar 14 provided on the outer face of the cylindrical extension 13. Now, the retaining tongues 11 are free to move outwardly as they do not abut against the collar 4 any longer. If the outer cap member 1 is further displaced upwardly, the retaining tongues 11 move back and the cap 1, together with its sealing insert 7, can be removed from the bottle without the trouble of overcoming a considerable resistance.

The bottle cap as described above and shown in the drawing is of very simple construction and provides a reliable operation under any circumstances. The sealing effect is ensured not only at rising temperatures, but also at low temperatures, e.g. in a refrigerator. The bottle can be opened easily and without any effort, no tool whatsoever being needed. It must also be mentioned that the cap according to the invention offers a great advantage in the production, resulting from the design of the sealing insert 7.

The form of the inner sealing member 15 which is, as shown in the drawing, slightly conical at its lower part 16 (cf. broken lines 20), would make it very difficult to remove the inner sealing member 7 from a moulding die. It would require a considerable force to push out the finished part out of the die thereby increasing the production time unduly. By the provision of slots in part 16", as proposed in the embodiment according to the invention, the slots being arranged below the sealing edge 21, this difficulty is overcome as the part 16" can be spread easily. In this way the force required to remove the finished part from the die is substantially less and the time required for the production of the sealing member is effectively shortened.

A further purpose of said slots is to enable the cap to be removed from a highly pressurized bottle without any pop, because upon removing the cap the pressure can gradually and continuously escape through the upper end of the slots, before the opening of the bottle is fully cleared.

Thereby a foaming of the liquid is prevented and nothing of the bottle's content will inadvertently escape.

What I claim is:

1. A re-usable bottle cap adapted to reliably seal a bottle at high or low temperatures which is easily removed by hand and effectively prevents escape of liquid contents or carbon dioxide comprising:

an outer hard plastic cap member;

an inner flexible, soft plastic sealing insert comprising a dished top member, an inner bottle sealing member below said dished top shoulder, a cylindrical outer side wall mounted within said hard plastic cap member and tapered tongues at the side wall;

a generally cylindrical opening ring with tapered side walls lying below and integral with the bottom edge of the side walls of said hard plastic cap member adapting the ring to fit over the shoulder of the bottle;

said taper having an inner wall sloping upwardly and inwardly from the bottom edge adapting fitting over the shoulder of the bottle;

said inner bottle sealing member below said dished top comprising a plurality of wall parts separated by slots which are formed integrally with the walls for opening of the bottle;

said outer hard plastic cap member having an angularly projecting inner stop collar adjacent the bottom of said cap creating a recess above said opening ring for receiving the tapered tongues of the collar; and said outer hard plastic cap member being further provided with a recess above said stop collar which permits the axial displacement of the inner sealing insert, 2. A bottle cap as claimed in claim 1 wherein the outer cylindrical walls of said outer cap member are provided with corrugations to facilitate grasping, capping and uncapping.

3. A bottle cap as claimed in claim 1 wherein said inner sealing insert is provided with an upper cylindrical extension having an integral collar portion protruding outwardly in a radial direction to facilitate abutment of the inner sealing insert against the inner upper edge of the outer cap member during capping.

* * * * *